US008590738B2

(12) United States Patent
Formon et al.

(10) Patent No.: US 8,590,738 B2
(45) Date of Patent: Nov. 26, 2013

(54) PAPER PRODUCT DISPENSING SYSTEM

(75) Inventors: John S. Formon, Appleton, WI (US); Craig Billman, Phoenixville, PA (US); Jeffrey J. Brickl, Lodi, WI (US); John W. Grosz, Waupun, WI (US); Wayne Hansen, Poynette, WI (US); Matthew T. Woerpel, Lodi, WI (US); Edward A. Raleigh, Lodi, WI (US)

(73) Assignee: SCA Tissue North America LLC, Philadelphia, PA (US)

( * ) Notice: Subject to any disclaimer, the term of this patent is extended or adjusted under 35 U.S.C. 154(b) by 902 days.

(21) Appl. No.: 12/399,319

(22) Filed: Mar. 6, 2009

(65) Prior Publication Data

US 2010/0224647 A1 Sep. 9, 2010

(51) Int. Cl.

| | |
|---|---|
| ***B65H 3/06*** | (2006.01) |
| ***B65H 3/02*** | (2006.01) |
| ***B65H 3/16*** | (2006.01) |
| ***B65H 3/04*** | (2006.01) |
| ***A47B 97/00*** | (2006.01) |

(52) U.S. Cl.
USPC ..... 221/217; 221/92

(58) Field of Classification Search
USPC ..... 221/1, 33, 36, 38, 40, 41, 45, 47, 55, 221/92, 97, 102, 175, 176, 191, 208, 210, 221/212, 217, 218, 221, 222, 224, 239, 253, 221/280
See application file for complete search history.

(56) References Cited

U.S. PATENT DOCUMENTS

| | | | | |
|---|---|---|---|---|
| 1,893,725 | A | 1/1931 | Boomershine | |
| 2,092,166 | A * | 9/1937 | Kettles, Jr. | 221/38 |
| 2,337,065 | A * | 12/1943 | Price | 221/15 |
| 3,785,523 | A | 1/1974 | Goldstein | |
| 4,494,948 | A * | 1/1985 | Teyssier, Jr. | 493/11 |
| 5,513,773 | A * | 5/1996 | Cargill | 221/231 |
| 5,616,113 | A * | 4/1997 | Van Den Bergh | 493/23 |
| 5,908,137 | A * | 6/1999 | Pattarozzi | 221/45 |
| 6,440,052 | B1 * | 8/2002 | Reider et al. | 493/410 |
| 6,704,616 | B2 | 3/2004 | Formon | |
| 6,874,653 | B2 * | 4/2005 | Boone et al. | 221/36 |
| 7,234,610 | B2 | 6/2007 | Skarda | |
| 2002/0030061 | A1 | 3/2002 | Formon | |
| 2004/0050857 | A1 | 3/2004 | Norton | |
| 2007/0152010 | A1 * | 7/2007 | Denen et al. | 225/10 |
| 2010/0114366 | A1 * | 5/2010 | Case et al. | 700/232 |
| 2010/0274384 | A1 * | 10/2010 | Nordlund et al. | 700/240 |

FOREIGN PATENT DOCUMENTS

| | | |
|---|---|---|
| CN | 1168089 A | 12/1997 |
| CN | 1678228 A | 10/2005 |

OTHER PUBLICATIONS

International Preliminary Report on Patentability in Application No. PCT/US2010/021927.
Chinese Office Action issued May 6, 2013 in corresponding Chinese patent application No. 201080009930.3 (and English translation thereof) (14 pages).

* cited by examiner

*Primary Examiner* — Gene Crawford
*Assistant Examiner* — Kelvin L Randall, Jr.
(74) *Attorney, Agent, or Firm* — Drinker Biddle & Reath LLP

(57) ABSTRACT

A dispensing system that removes individual napkins from a stack of interfolded napkins in a manner that allows the number of napkins dispensed to be easily counted and controlled so that an appropriate number of napkins are dispensed. The counted napkins are collected in an easily manageable form and presented to a user.

17 Claims, 7 Drawing Sheets

SECTION A-A

SECTION A-A

SECTION A-A

SECTION A-A

PAPER PRODUCT DISPENSING SYSTEM

FIELD OF THE INVENTION

The present invention relates to a dispensing system for dispensing a number of paper products from a dispenser.

BACKGROUND OF THE INVENTION

Paper products such as napkins, paper towels, or the like are often provided to a customer at fast food establishments or other places where food and/or drinks are served. A napkin is an exemplary paper product and is discussed below. Often, when napkins are provided as part of a "to go" order or at a drive-thru, a server just grabs a random number of napkins and gives the napkins to the customer as part of the customer's order. Such napkins might be loose in a pile or might be stacked in a napkin dispenser.

However, often too many or too few napkins are presented to a customer by a server. Dispensing too many napkins to the customer is a waste of money for the food establishment. Dispensing too few napkins could lead to a customer becoming dissatisfied with the overall service of the establishment.

Accordingly, there is a need for a dispensing system that provides a predetermined number of napkins to a customer based on the specific food item or items that the customer orders. Such an automated dispenser would dispense the proper number of napkins for every order and eliminate human error and guesswork.

SUMMARY OF THE INVENTION

In view of the above, the present inventors have invented a novel dispensing system. In one embodiment, the dispensing system works with an existing interfolded napkin, so that the same type of napkin dispensed by the present dispensing system and provided by the server for "to go" orders is also dispensed by the customer at napkin dispensers that are accessible to the customer, i.e. within the food service establishment. In this way, a single napkin Stock Keeping Unit (SKU) or other code assigned to a product to identify the price, product options and manufacturer can be used by the food service establishment for all the dispensers in the establishment for ease of use and reordering.

In one embodiment, a predetermined amount of napkins can be dispensed from a stack of interfolded napkins by automated gripping fingers pulling a leading edge of each of the napkins one-at-a-time from an opening in the dispenser. As the dispensed napkin is withdrawn from the stack, the dispensed napkin unfolds. Then, each dispensed napkin is folded upon itself and a predetermined amount of folded napkins are collected in a collection tray and presented to the customer as part of their order.

BRIEF DESCRIPTION OF THE DRAWINGS

Other objects, features and advantages of the dispensing system according to the invention will be more readily apparent after reading the following detailed description of embodiments with reference to the appended drawing figures, in which.

DETAILED DESCRIPTION OF EMBODIMENTS

Figure 5:
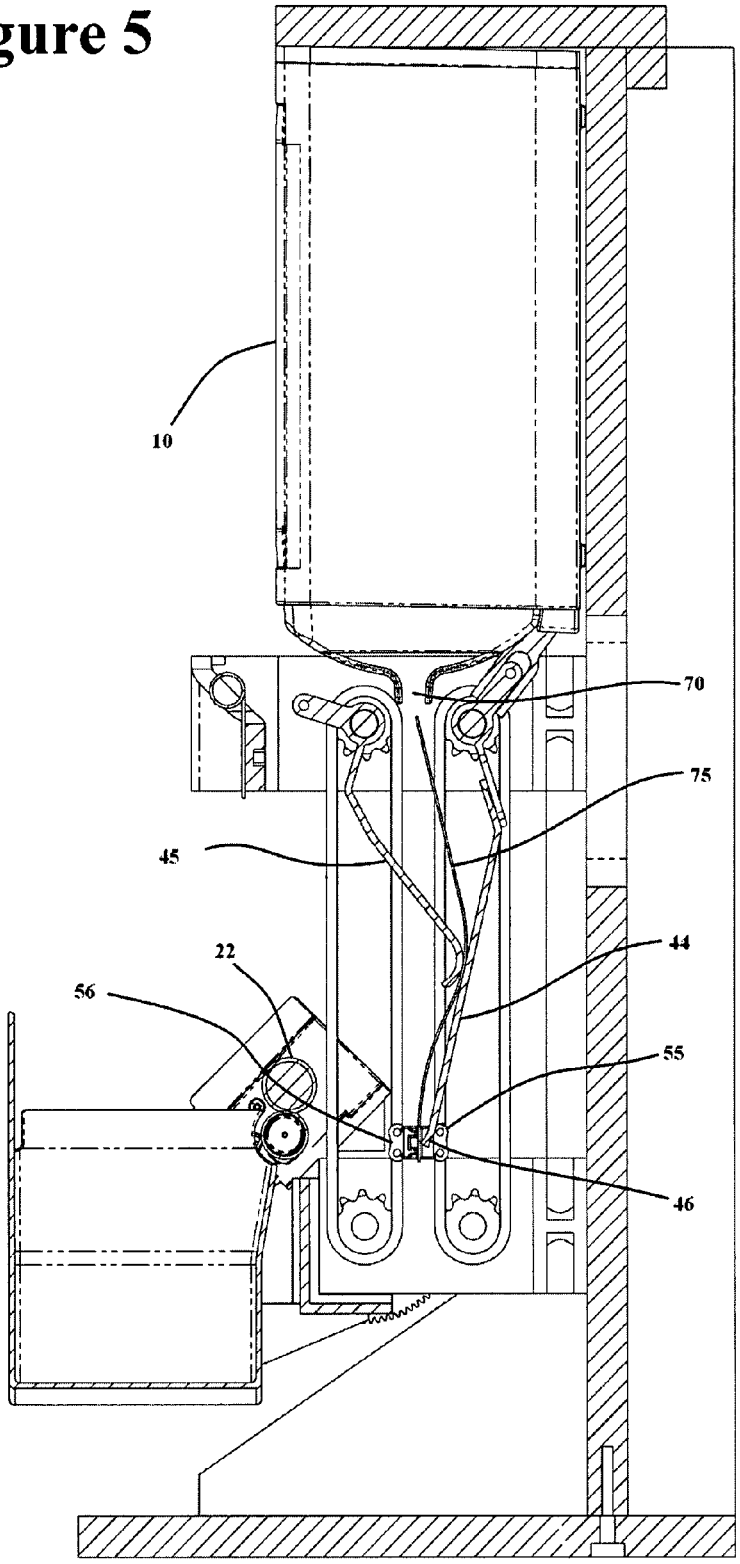
FIG. 5 depicts a sectional view of the dispensing system of FIG. 3 along line A-A in a second position.
Figure 6:
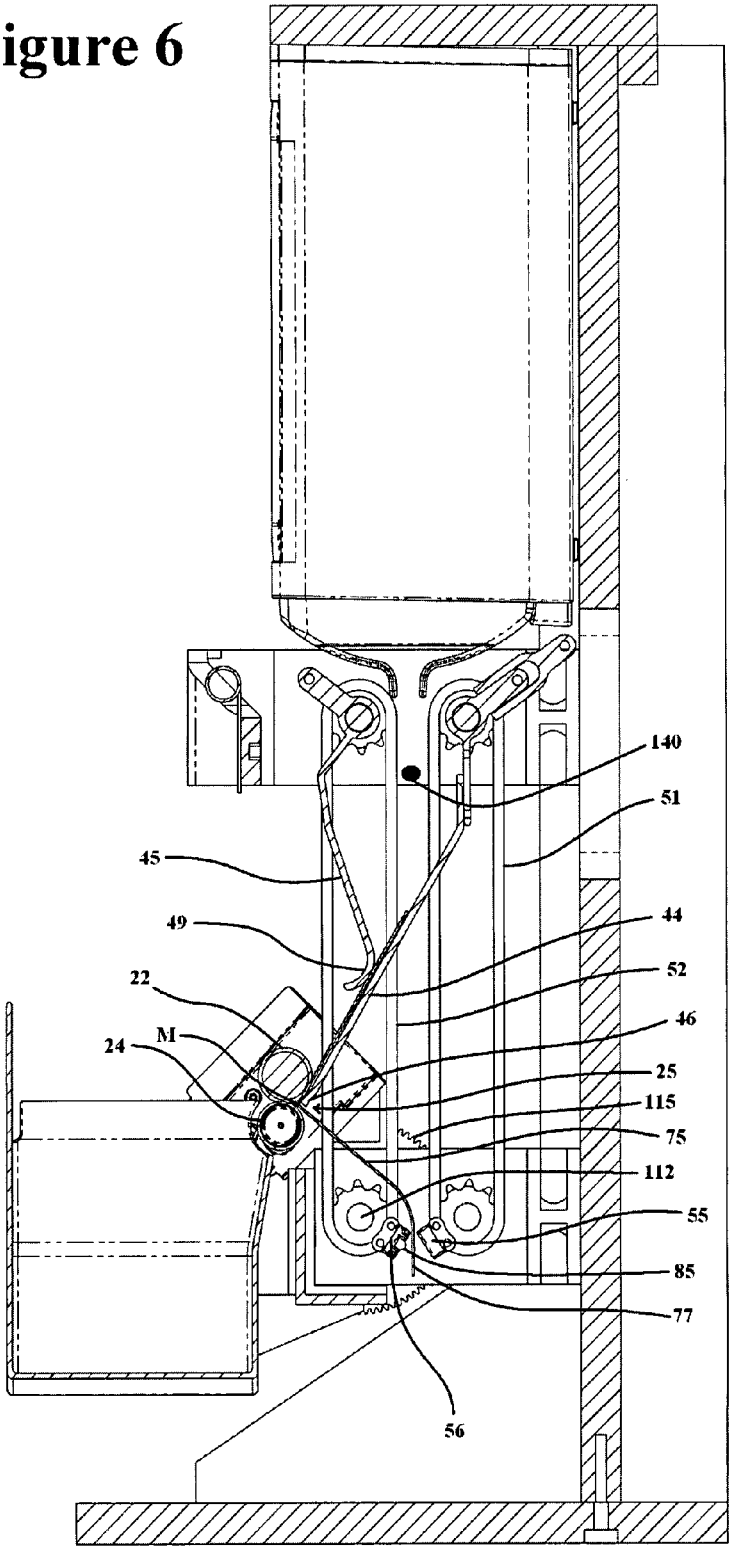
FIG. 6 depicts a sectional view of the dispensing system of FIG. 3 along line A-A in a third position.
Figure 7:
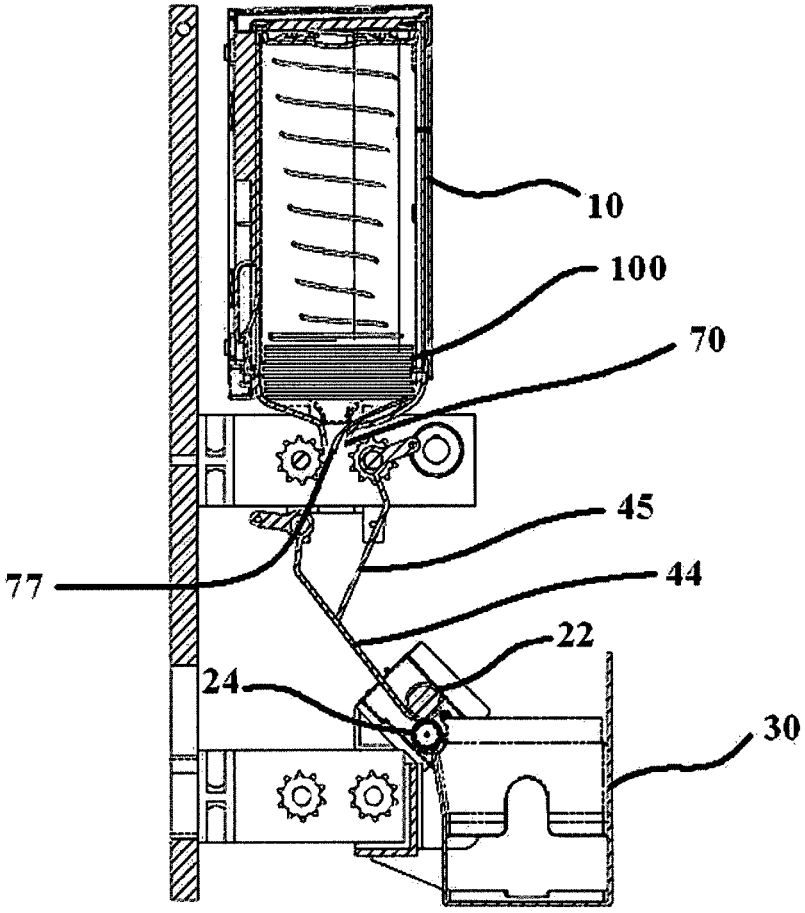
FIG. 7 depicts a side view of a dispensing system according to the invention with certain elements removed in order to see other features of the invention.

In FIGS. 1-7, it can be seen that the dispenser 5 includes a paper product holder 10 that holds a supply of paper products 100 (see FIG. 7). In one embodiment, the paper products are part of cartridge based loading system whereby multiple cartridges containing the paper products might be preloaded with product and placed in a staging area. The paper product holder 10 would initially be loaded with a full cartridge. Once the cartridge becomes depleted, another full cartridge would readily be available from the staging area for placement into the paper product holder 10. The cartridge might consist of the paper product packaging, a separate part, or an assembly of parts. Of course, a cartridge is not required to load the paper product into the holder.

In another embodiment, a plurality of holders might be moveably attached to the dispenser such that each holder 10 could be loaded with paper product and moved between a staging position and a feeding position. The feeding position would align one holder to feed the dispenser paper product. As the feeding holder becomes depleted it would be moved from the feeding position to a staging position. This motion would bring a previously staged holder into the feeding position. Such holder movement might require a manual actuation or it could be automated.

In a presently preferred embodiment, the holder 10 includes a downwardly facing opening 70 (see FIG. 7) through which a first one of the paper products extend. An example of such a dispensing opening is disclosed in applicant's co-pending application Ser. No. 10/938,527, the entirety of which is hereby expressly incorporated by reference. Of course, dispensing is not limited to a downward facing opening and one of ordinary skill in the art would readily recognize that the dispenser might be configured, for example, to have a sideways facing opening, or even an upward facing opening (so long as a mechanism is used to push the paper products toward the opening) for such upward facing opening.

As known in the art, paper products refer to items such as napkins, paper towels, or the like. The term napkin as used below is used as an exemplary paper product and is not meant to limit the invention. The presently preferred napkin is an interfolded napkin 75. Such an interfolded napkin presents a leading edge for each successive napkin. An example of such an interfolded napkin is disclosed in applicant's co-pending application Ser. No. 12/055,334, the entirety of which is hereby expressly incorporated by reference. Folded napkins that are not interfolded and unfolded napkins are also contemplated for use in the present invention.

Figure 4:
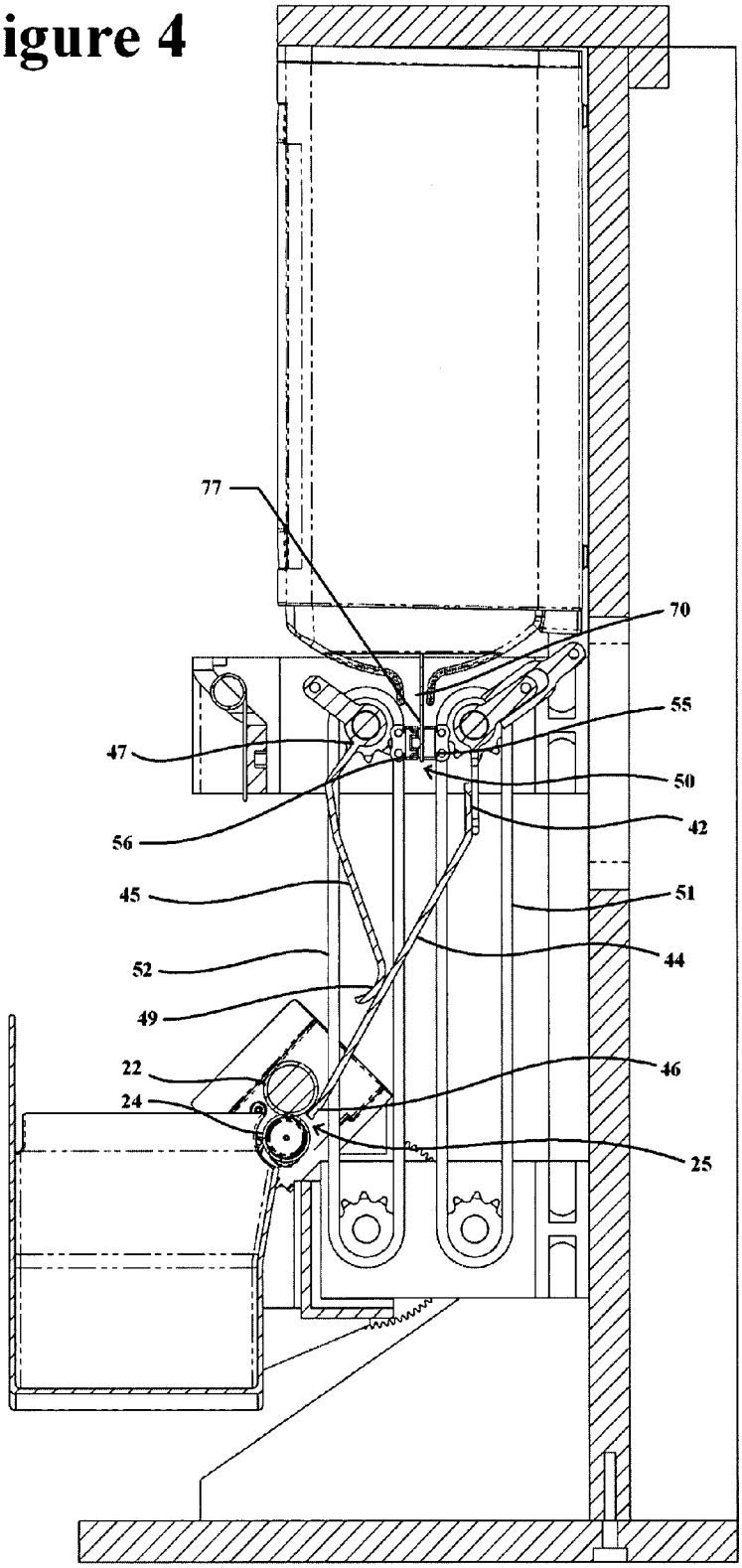
FIG. 4 depicts a sectional view of the dispensing system of FIG. 3 along line A-A in a first position.

As best seen in FIG. 4, the dispenser further includes a movable grabbing mechanism 50 that grabs the leading edge 77 of the napkin one-at-a-time from the opening 70 and withdraws the paper products completely from the holder 10. The grabbing mechanism shown is an exemplary mechanism wherein the napkins are withdrawn from the stack using a mechanical gripping device incorporated with a linear or rotational motion to grip the napkins one-at-a-time by each leading edge at the point where the napkin is protruding from the holder 10. The mechanical gripping device moves to a point such that the napkin is removed from the stack and then releases the grip allowing the napkin to be cleared from the mechanism before returning to its original position where it could grip the next napkin. An exemplary mechanical gripping device might include rubber fingers, or fingers having a magnetic attraction, which tends to draw the fingers toward each other. See, for example, magnet 85 of FIG. 6. Alternatively, the napkins might be pulled from the stack one-at-a-time using nip rollers, or the napkins might be pulled from the stack using vacuum rollers.

For these above noted alternatives, or even for an embodiment with a mechanical gripping device, the leading edge of the napkin need not be what is used to pull the napkin from the holder. Rather, an edge exposed to the opening at one end of the stack, an outwardly exposed planar portion, or any other part of the napkin that is exposed to the opening might be used to pull, grab or otherwise withdraw the napkin from the holder, regardless of whether the napkin is interfolded, folded but not interfolded, or unfolded.

Figure 1:
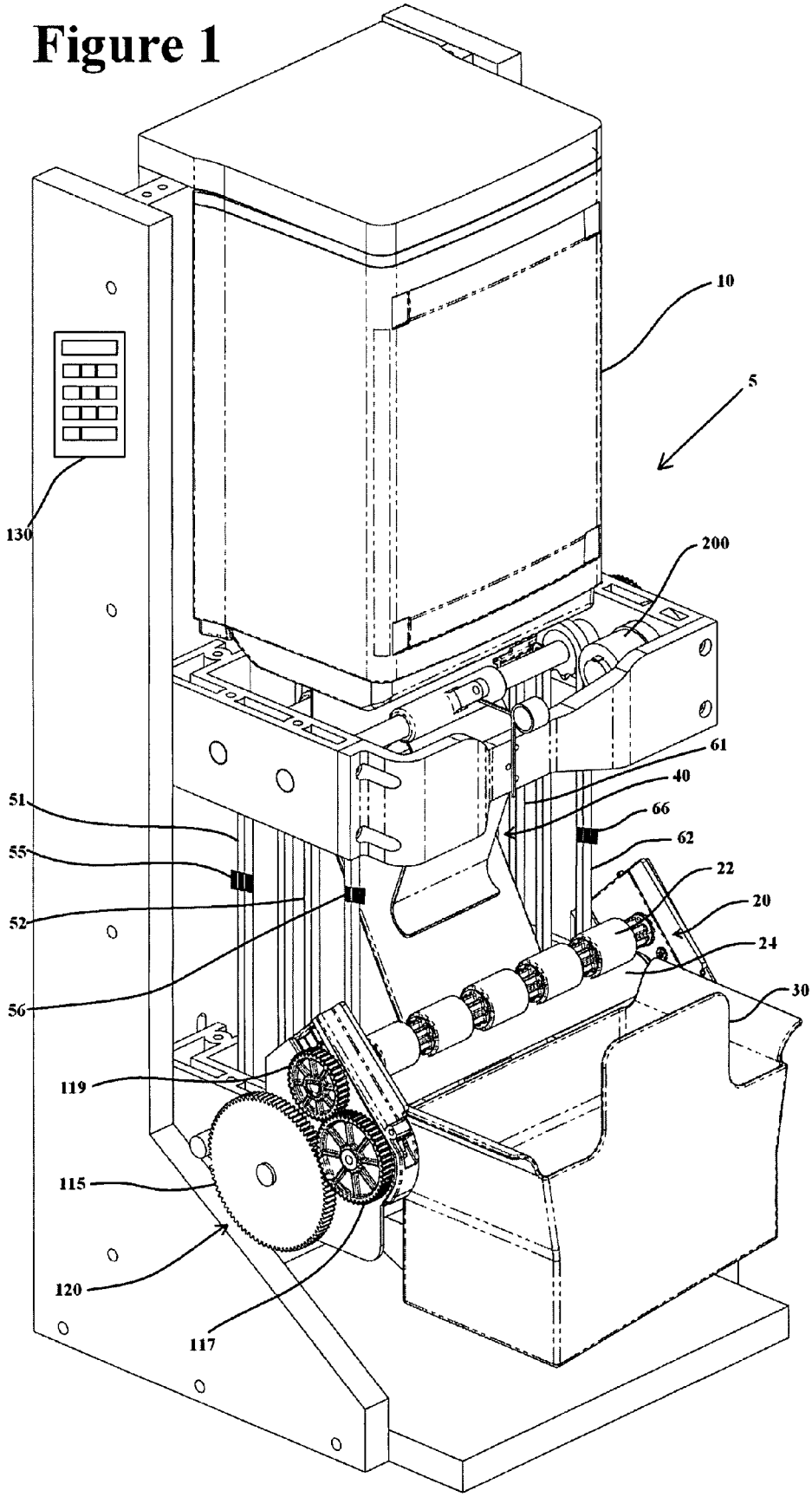
FIG. 1 depicts a perspective view from the left side of a dispensing system according to the invention.
Figure 2:
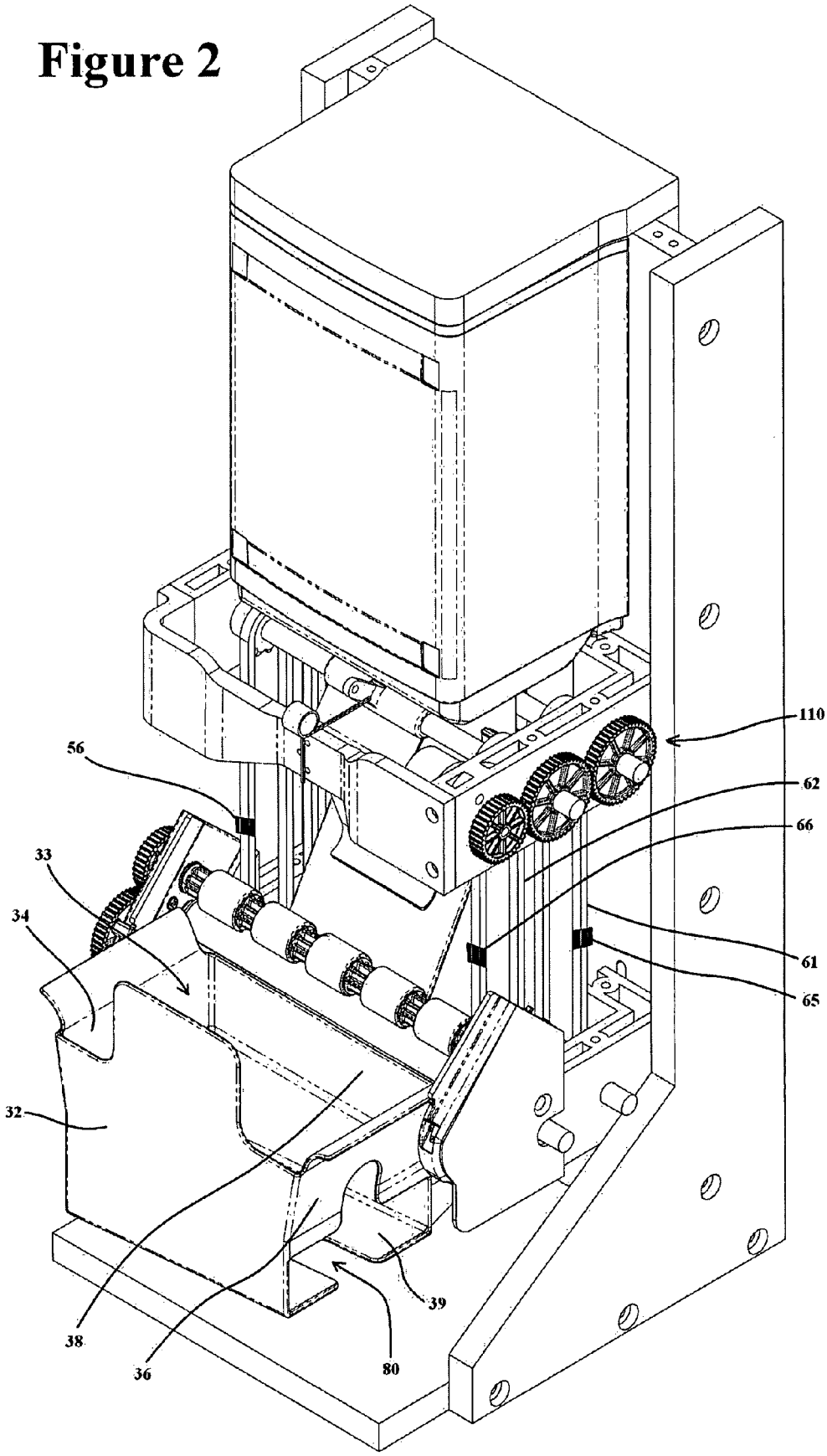
FIG. 2 depicts a perspective view from the right side of the dispensing system of FIG. 1.
Figure 3:
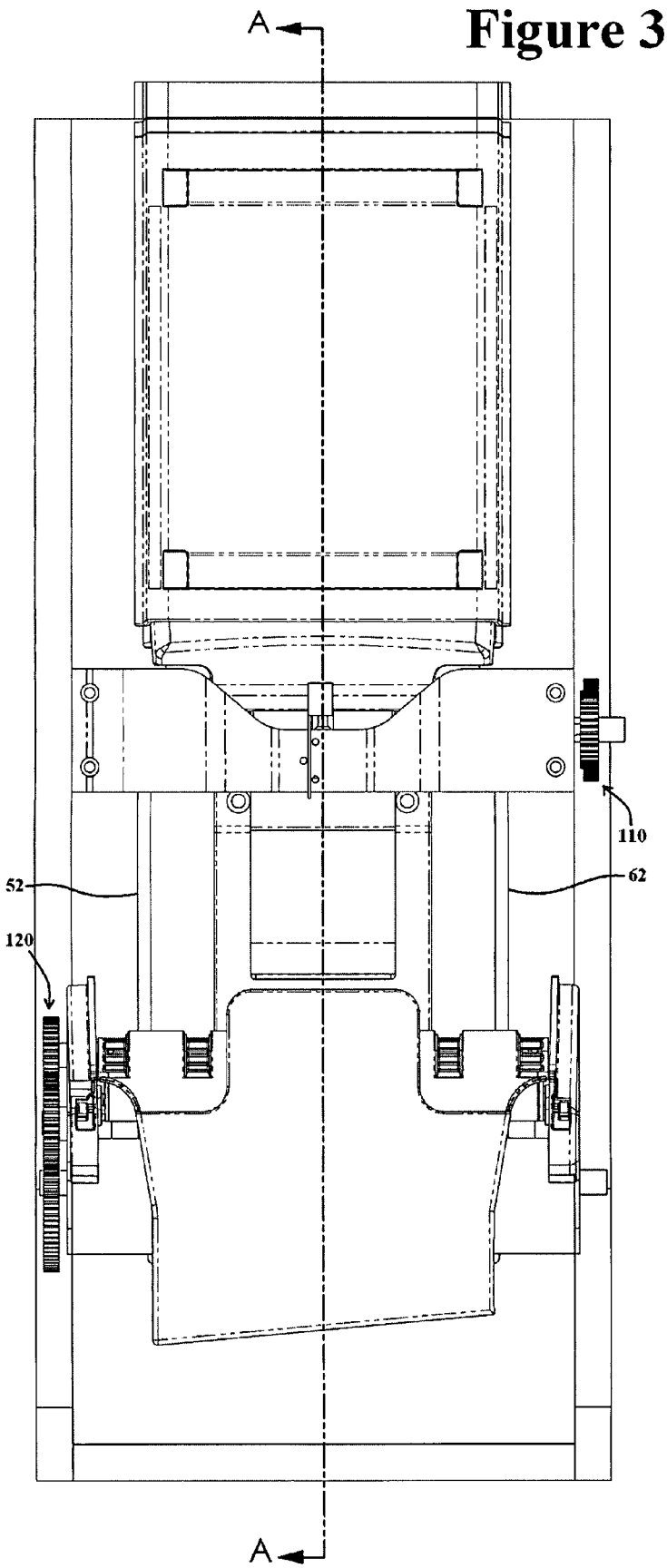
FIG. 3 depicts a front view of the dispensing system of FIG. 1.

In the presently preferred embodiment the dispenser 5 also includes a folder 20 (see FIG. 1) that receives the napkins withdrawn completely from the holder 10 by the grabbing mechanism 50 and that folds each napkin upon itself to form a refolded napkin. As described below, the napkin 75 unfolds as it is withdrawn from the holder 10 and then is refolded by the folder 20. In FIG. 1, the folder 20 is depicted in an exemplary manner by a pair of opposing rollers 22, 24 forming a nip 25 therebetween (see FIG. 4). An example of such a nip configuration is disclosed in applicant's co-pending application Ser. No. 11/390,185, the entirety of which is hereby expressly incorporated by reference.

However, the present invention is not meant to be limited by the two roller configuration, and other ways of folding the withdrawn napkin upon itself would be readily apparent to those of ordinary skill in the art including, but not limited to a bar that forces at least one unfolded napkin through a slot to fold the napkin as the napkin is pushed through the slot. Alternatively, the folder 20 is omitted and the napkins are not refolded (or were never folded in the first place).

The withdrawn napkins, whether they are unfolded (an embodiment where there is no folder), or refolded by the folder, are then collected. In the presently preferred embodiment, the napkins are collected in a collection tray 30 that is immediately downstream of the folder 20 (in a direction away from the napkin holder 10) and is rigidly connected to the folder 20 so that as each napkin 75 (see FIG. 5) is folded by the folder 20, the napkin 75 falls by the force of gravity into the collection tray 30 without the collection tray moving. In an embodiment without a folder, the collection tray 30 or other collection area might be substantially vertically below the holder to allow the napkins to fall by the force of gravity for collection after they are withdrawn from the holder.

In one embodiment, the individual napkins might be collated into a single stack which is then presented to the user. The full stack might be presented in a flat, semi folded, or fully folded configuration to the user. In another embodiment, the napkins might be collected rotationally around a mandrel type device which would wrap the napkins around a core. The napkins could then be pulled or ejected from the core to be presented to the user.

In another embodiment, the napkins might be presented through an opening in the dispenser from which the user would remove them or could be dispensed into a tray outside of the main dispenser body.

For the presently preferred embodiment, the collection tray 30 has four sides 32, 34, 36, 38 (see FIG. 2), a bottom 39 and an open top 33. The napkins withdrawn from the holder 10 enter the collection tray 30 through the open top 33. In the presently preferred embodiment, at least one side (side 36 in FIG. 2) of the four sides 32, 34, 36, 38 is spaced apart from the bottom 39 so as to form an opening 80 to ease removal of the napkins from the collection tray 30.

When the dispenser 5 includes folder 20 having the pair of rollers 22, 24, an urging device 40 may be provided in order to ensure that the napkin 75 enters the nip 25 for folding. Such an urging device 40 urges the paper products withdrawn from the holder 10 by the grabbing mechanism 50 toward the nip 25.

In the presently preferred embodiment, the urging device 40 includes a first plate 44 having a first end 42 pivotally connected adjacent behind the opening 70 and having a second end 46 movable toward said nip 25 so as to place the napkin 75 into the nip 25 (see FIG. 6). When napkins are not being dispensed, the first plate is biased against the roller 22 using a spring or other biasing device. Contact between the first plate and the roller 22 when napkins are not being dispensed is not necessary and the first plate could be spaced apart from roller 22 at this time. However, any bias created by the spring or other device must be sufficient to urge the napkin 75 into the nip 25.

The urging device also includes a second plate 45 having a first end 47 pivotally connected adjacent to a second side of said opening and having a second end 49 movable toward said first plate so as to maintain tension on the napkin 75 as the napkin 75 is being moved into said nip 25.

An exemplary sequence of movement of the urging device 40 is shown in FIG. 4 through FIG. 6. First, as seen in FIG. 4, the leading edge 77 of the napkin 75 extends through the opening 70 due to the trailing edge of the preceding napkin pulling the napkin therethrough in a manner known per se for interfolded napkins. The leading edge 77 of the napkin 75 is grasped by grabbing mechanism 50.

In a presently preferred embodiment, the grabbing mechanism 50 includes a pair of opposing gripping fingers 55, 56 that grasp the napkin therebetween on one side of the napkin. The grabbing mechanism 50 also includes gripping fingers 65, 66 that grasp the napkin therebetween on another side of the napkin. Each gripping finger 55, 56 and 65, 66 is connected to a respective endless loop. That is gripping finger 55 is connected to endless loop 51, gripping finger 56 is connected to endless loop 52, gripping finger 65 is connected to endless loop 61, gripping finger 66 is connected to endless loop 62. The endless loop might be a chain or belt or the like. Although only one gripping finger is shown per endless loop, nevertheless, two or more gripping fingers might be provided on each endless loop that are spaced from each other so as to reduce the time that grippers are not pulling napkins.

The endless loops, 51, 52, 61, 62 are moved in unison by a gear system 110 driven by a motor 200 (see FIG. 1) so that as seen in FIG. 4, the grippers 55, 56 grab the leading edge 77 of the napkin 75 in a first position, whilst the first plate 44 is against roller 22 and the second plate 45 is against the first plate 44. Although only grippers 55 and 56 are shown in FIGS. 4-6, nevertheless, one of ordinary skill in the art would readily recognize that based on their connection to the gear system 110, grippers 65, 66 would also grab the leading edge 77 of the napkin 75 in the first position, but on the other side of the napkin 75. The remainder of the napkin is still within the holder 10 in the first position.

FIG. 5 shows a second position wherein the grippers 55, 56 (and 65, 66) still hold the leading edge of the napkin 75 therebetween. In the second position, the napkin 75 has now been completely withdrawn from the holder 10 and is unfolded. The napkin is now between the first plate 44 and the second plate 45. Since the endless loops 51, 52 and 61, 62 are spaced from the rollers 22, 24, as the grippers are moved from the first position to the second position; the first plate 44 is pivoted away from the roller 22 so that as seen in FIG. 5 the first plate 44 is separated from and moves away from the rollers 22, 24.

FIG. 6 shows a third position where the grippers 55, 56 (and 65, 66) are moving away from each other and have released the leading edge 77 of the napkin 75. At this time, the first plate 44 pivots back toward the rollers 22, 24. Because the napkin 75 is still on the first plate 44, as the first plate 44 nears the rollers 22, 24, a central portion M of the napkin 75 is urged into the nip 25 between the rollers 22, 24.

At the time the napkin 75 is urged toward the nip 25, the rollers 22, 24 are rotating based on gear 115. As seen in FIG. 1, gear 115 is part of gear system 120, which also includes gears 117 and 119. As gear 115 rotates counter clockwise (as seen from the left side view of FIG. 1), the gear 117 rotates clockwise, which in turn rotates gear 119 counter clockwise to draw the napkin 75 into the rollers as the first plate 44 is urging the napkin 75 into the nip 25. In addition, as seen in FIG. 6, since gear 115 is on a common shaft 112 with the endless loop 52 (as well as endless loop 62), gear 115 moves together with the endless loop 52, which is driven by motor 200.

Based on the exemplary dispenser described above, one of ordinary skill in the art would understand that such a dispenser is capable of dispensing a specific number of paper products from a larger quantity of paper products e.g., the supply of paper products 100. The dispenser might be configured to dispense a specific number of paper products based on input from a user, or from an electronic system such as an electronic cash register connected to the dispenser. An example of a user input device is key pad 130 that is electronically connected to the motor 200 and/or a counting mechanism or counting circuitry. The key pad might be attached to the dispenser as seen in FIG. 1, or be remote therefrom. Once the predetermined number of paper products is input for a particular order that predetermined number of paper products will then be presented to the user.

In the presently preferred embodiment described above, the predetermined number of napkins might be counted as they are removed from the stack by pulling one napkin at a time in such a way as to create a space between it and each subsequent napkin as they are pulled. Such counting might be performed by a sensor 140 (see FIG. 6) such as an optical or infrared sensor that identifies the gap between napkins, or that identifies an edge of the napkin, i.e. each napkin's leading edge or trailing edge, allowing them to be counted. Although a single sensor 140 is shown, one of ordinary skill in the art would recognize that a pair of sensors, one having a transmitting function and the other having a receiving function could also be used.

Alternatively, the number of rotations of the motor 200 might be counted and correlated to the number of napkins dispensed. For the embodiment described above that includes magnetic gripping fingers, the magnet might pass by a sensor and that sensor determines how many times the magnet has passed. The above-mentioned devices for determining the number of napkins dispensed are meant to be exemplary and one of ordinary skill in the art would readily understand that any known device or electrical configuration for counting objects, determining the number of rotations of a motor or belt, or that indicates the repeat of an occurrence is contemplated by the present invention. Regardless of the method for determining the number of napkins dispensed, the counted napkins are then collated or restacked as described above and presented to the user in a manageable fashion.

While the present invention has been described in connection with various preferred embodiments thereof, it is to be understood that those embodiments are provided merely to illustrate the invention, and should not be used as a pretext to limit the scope of protection conferred by the true scope and spirit of the appended claims.

We claim:

1. A dispenser for dispensing a predetermined number of paper products, comprising:

a paper product holder for holding a supply of paper products;

two pairs of movable grasping fingers that grab the paper products one-at-a-time and withdraw said paper products completely from said holder, at least one finger of each of said two pairs of gripping fingers being movable from a first position, where respective fingers of each pair of gripping fingers are spaced apart from each other, to a second position, where respective fingers of each pair of gripping fingers are closer to each other so as to grab one of the paper products, and said gripping fingers each include a magnet at a tip thereof that maintain said respective fingers in the second position;

a collection tray for collecting the paper products withdrawn from said holder by said grasping fingers; and a folder that receives the paper products withdrawn from the holder by the grasping fingers and refolds said paper products.

2. The dispenser according to claim 1, wherein said folder comprises two opposing rollers forming a nip therebetween.

3. The dispenser according to claim 2, further comprising an urging device that urges the paper products withdrawn from said holder by said grasping fingers toward said nip.

4. The dispenser according to claim 1, wherein each of said gripping fingers are attached to a corresponding continuous chain or belt.

5. The dispenser according to claim 1, wherein said paper product holder includes a face plate having an opening configured to dispense said paper products one-at-a-time, and wherein said supply of paper products are interfolded paper products.

6. The dispenser according to claim 1, wherein said collection tray has four sides, a bottom and an open top, the paper products withdrawn from said holder enter said collection tray through the open top.

7. The dispenser according to claim 6, wherein at least one of said four sides is spaced apart from said bottom so as to form an opening to remove the paper products from said collection tray.

8. A device for dispensing a predetermined amount of napkins from a stack of interfolded napkins, said device comprising:

a napkin holder loaded with a plurality of interfolded napkins, said holder having a downwardly facing napkin dispense opening;

grippers two pairs of gripping fingers downstream of said opening that grip a leading edge of each successive one of said plurality of napkins, each finger of said two pairs of gripping fingers having a front side and a back side and being movable on a respective endless loop from a first position so that each respective pair of gripping fingers has a back side facing each other, to a second position so that a front side of each said respective pair of gripping fingers face each other, in said second position, each said respective pair of fingers move toward each other and are configured to grab one of the napkins;

a pair of rollers downstream of said opening, said pair of rollers forming a nip therebetween, each said napkin is fed by said pair of grippers two pairs of gripping fingers to said nip and is folded upon itself to form a fold by said pair of rollers; and a collection tray adjacent to said pair of rollers, folded napkins exiting the nip are collected in said collection tray.

9. The device according to claim 8, further comprising an urging device that urges the napkins withdrawn from said holder by said two pairs of gripping fingers toward said nip.

10. The device according to claim 9, wherein said urging device comprises a first plate having a first end pivotally connected adjacent to a rear side of said opening and having a second end movable toward said nip and configured to insert the napkin into said nip.

11. The device according to claim 10, wherein said urging device comprises a second plate having a first end pivotally connected adjacent to a front side of said opening and having a second end movable toward said first plate so as to maintain tension on said napkins as said napkins are being moved into said nip.

12. The device according to claim 8, further comprising a sensor downstream of said opening that detects each napkin that passes through said opening in order to determine said predetermined amount of napkins.

13. A method for dispensing a predetermined amount of napkins from a stack of interfolded napkins, said method comprising:

withdrawing each of said napkins one-at-a-time from a dispenser opening by gripping leading edges in two pairs of magnetic gripping fingers;

folding a dispensed napkin upon itself; and collecting a predetermined amount of folded napkins in a collection tray.

14. The method according to claim 13, wherein said step of folding the dispensed napkin upon itself comprises feeding a central portion of the dispensed napkin into a nip formed between a pair of rollers.

15. The method according to claim 14, wherein said step of feeding the central portion of the dispensed napkin into the nip comprises pushing the central portion into the nip using a plate that is biased to pivot toward said nip.

16. The method according to claim 13, wherein said step of collecting the predetermined amount of folded napkins in the collection tray comprises letting the folded napkins fall by gravity into the collection tray.

17. The method according to claim 13, further comprising the step of counting dispensed napkins to ascertain the predetermined amount of napkins.

* * * * *